United States Patent [19]

Cummins

[11] Patent Number: 4,500,266

[45] Date of Patent: Feb. 19, 1985

[54] LINEAR PERISTALTIC PUMP

[75] Inventor: Donald L. Cummins, Hopewell, Va.

[73] Assignee: AMF Incorporated, White Plains, N.Y.

[21] Appl. No.: 559,004

[22] Filed: Dec. 8, 1983

Related U.S. Application Data

[63] Continuation of Ser. No. 305,011, Sep. 24, 1981, abandoned.

[51] Int. Cl.[3] ..... F04B 43/12; F04B 45/08

[52] U.S. Cl. ..... 417/474

[58] Field of Search ..... 417/474, 475

[56] References Cited

U.S. PATENT DOCUMENTS

| | | | |
|---|---|---|---|
| 2,877,714 | 3/1959 | Song et al. | 417/474 X |
| 3,180,272 | 4/1965 | Breadfoot | 417/475 X |
| 3,296,047 | 1/1967 | Parr | 156/143 X |
| 3,687,580 | 8/1972 | Griffiths | 417/476 X |
| 3,693,382 | 9/1972 | Grahtham | 417/474 X |
| 3,778,195 | 12/1973 | Bamberg | 417/474 |
| 4,294,802 | 10/1981 | Johansson | 417/475 X |

FOREIGN PATENT DOCUMENTS

| | | | |
|---|---|---|---|
| 2454763 | 5/1975 | Fed. Rep. of Germany | 417/474 |
| 369037 | 3/1932 | United Kingdom . | |
| 637429 | 5/1950 | United Kingdom . | |
| 829329 | 3/1960 | United Kingdom . | |
| 923443 | 4/1963 | United Kingdom . | |
| 1182908 | 3/1970 | United Kingdom . | |
| 1228093 | 4/1971 | United Kingdom . | |
| 1287951 | 9/1972 | United Kingdom . | |
| 1357161 | 6/1974 | United Kingdom . | |
| 1450879 | 9/1976 | United Kingdom . | |
| 2006347 | 5/1979 | United Kingdom . | |
| 1572592 | 7/1980 | United Kingdom . | |
| 182874 | 8/1966 | U.S.S.R. | 417/474 |

*Primary Examiner*—Richard E. Gluck

*Attorney, Agent, or Firm*—David E. Dougherty; Thomas J. Durling

[57] ABSTRACT

A linear peristaltic type pump capable of moving high viscosity material without creating an appreciable amount of heat includes a flexible conduit that is progressively compressed by a series of gear-driven compressing shoes that move linearly into and out of contact with the conduit by reciprocating motion, with a dwell time provided for each conduit compression event. A specific gear and linkage drive system is provided, including interengaged gears driving the compressing shoes via links on either side of the shoes.

11 Claims, 4 Drawing Figures

LINEAR PERISTALTIC PUMP

This application is a continuation of application Ser. No. 305,011 filed Sept. 24, 1981, now abandoned.

This invention relates generally to pumps and more particularly to a pump having a flow path from the inlet to the outlet provided by a conduit with a deformable wall.

Apparatus of this general type are broadly classified as peristaltic pumps the basic principles of which are well known in the art. Probably, the best known peristaltic pump arrangement, embodies a stator with a U-shaped flexible conduit from the inlet to the outlet, and a stator with a plurality of cams engaging and collapsing the engaged bight portion of the conduit forming a closure which moves from the inlet to the outlet as the engaging cam rotates. Other or linear forms of peristaltic pumps generally embody a plurality of cams in juxtaposition acting on a linear flexible conduit to create contractions in the conduit wall for moving material through the conduit from the inlet to the outlet. The camming action as above creates heat and also causes linear stress and wear which are deleterious to the conduits. It has been a common concept that a properly functioning peristaltic pump requires a continuous running closure in the flow path at all times. This, however, in actual practice does not appear to be correct, particularly, when pumping material with high viscosity and strong self-adhering characteristics. It should be obvious that the propulsion by any pump will vary with differences in the characteristics of the material being handled.

Accordingly, an object of the present invention is to provide an axial type peristaltic pump capable of moving from low viscosity materials, such as water and other liquids, to high viscosity materials, such as raw dough.

Another object of the present invention is to provide the foregoing pump, the operation of which creates no appreciable temperature rise in the material moving from inlet to discharge.

And another object of the present invention, is to provide the foregoing pump with means for collapsing or creating a closure of the flexible conduit progressively advancing to move material to the discharge in a manner which does not create linear stresses in or cause undue wear of the flexible conduit.

The foregoing and other objects and advantages will appear more fully hereinafter from a consideration of the detailed description which follows, taken together with the accompanying drawings, wherein a single embodiment of the invention is illustrated by way of example. It is to be expressly understood, however, that the drawings are for illustration purposes only and are not to be construed as defining the limits of the invention.

Figure 1:
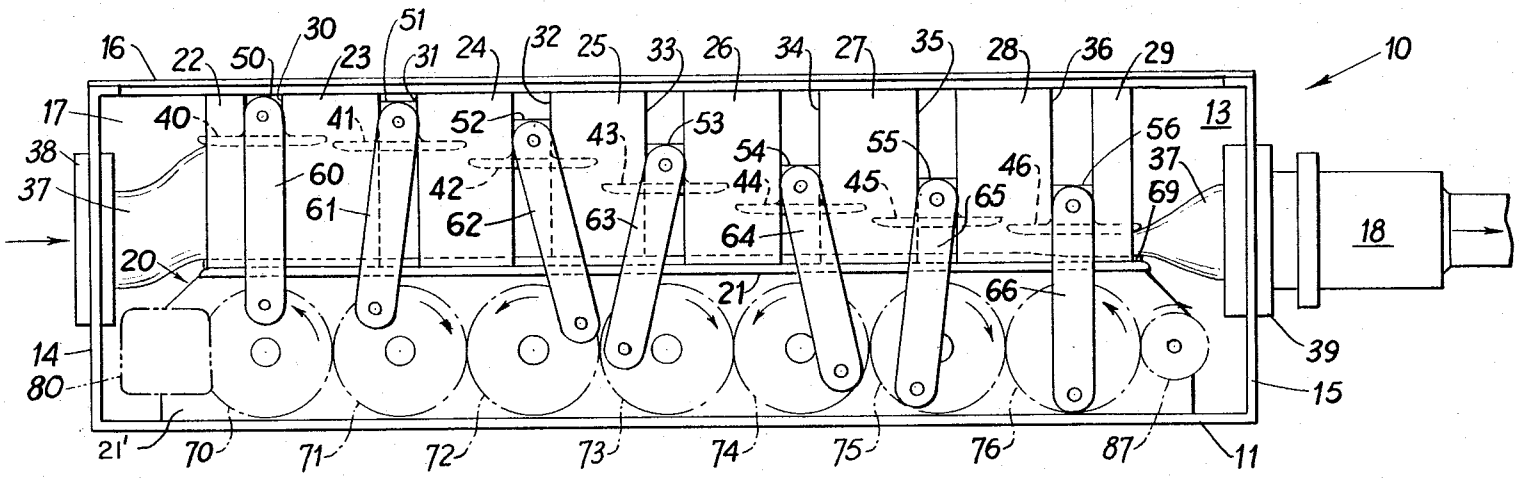
FIGS. 1 and 2 are elevational views with a side wall removed of a pump made in accordance with the present invention, only the timing of the pumps differing from each other.

Although the terms vertical, lateral and horizontal will be used hereinafter, they relate to the pump position as viewed in the drawings which is not to be construed as defining a limitation of the invention.

A preferred embodiment of the present invention is for moving a material of high viscosity and which is highly self adhesive, such as raw dough. However, a pump in accordance with the present invention, is not limited to moving such dough but can also be used for pumping water and materials with a low viscosity within a viscosity range of from water to raw dough.

Referring now to the drawings, a pump made in accordance with the present invention, has a housing 10 formed by a pair of spaced side walls 12 and 13, and end walls 14 and 15 all connected together and to a bottom wall 11 to define a chamber 17 closed at the top by a sealed cover 16. A frame 20 is disposed in the chamber 17 providing a conduit support surface 21 spaced from the bottom wall 11 and a laterally spaced pair of side walls which extend from the support surface 21 to the cover 16. Each side wall is formed by a series of equally spaced block members 22, 23, 24, 25, 26, 27, 28 and 29, disposed from one end of the surface 21 to the opposite end thereof, the interspaces between block members forming an equally spaced series of vertical guide surfaces or tracks 30, 31, 32, 33, 34, 35 and 36. The spaced block members 22 . . . 29 and the formed tracks or guide surfaces 30 . . . 36 of one side wall are laterally aligned with the corresponding block members and tracks of the other side wall. A pair of skirt sections 21' comprising opposed parallel walls depending from each edge of surface 21 and extending to the bottom wall 11.

A flexible conduit 37, disposed on the support surface 21, is provided with an inlet connection 38 at the end wall 14 and an outlet or discharge connection 39 at the end wall 15. The axes of the inlet 38 and outlet 39 are offset below the axis of the conduit 37 disposed on the support surface to prevent linear stresses at the ends of the conduit as will be further discussed.

A plurality of pressure shoes 40, 41, 42, 43, 44, 45 and 46 are disposed in a series within the side walls of frame 20 on the conduit 37 and have upwardly disposed stems 50, 51, 52, 53, 54, 55 and 56 which are generally rectangular in cross-section and extend laterally past the respective pressure shoes and into respective guide surfaces or tracks 30 . . . 36. Movement of the stems 50 . . . 56 in the vertical guide surfaces or tracks 30 . . . 36 causes the pressure shoes 40 . . . 46 to move in linear paths on axes normal to the axis of the flexible conduit and also prevent the pressure shoes from pendulum movement thereby preventing creation of linear stresses in the conduit 37. A set of links or arms 60, 61, 62, 63, 64, 65 and 66 are pivotally connected to each end of the corresponding stems 50 . . . 56.

The skirt portion 21' of the frame 20, which extends from the support surface 21 toward the bottom wall 11 supports a plurality of laterally spaced pairs of gears 70, 71, 72, 73, 74, 75 and 76 sequentially in mesh with one another forming a gear train on both sides of the frame 20. Gears 70 . . . 76 rotate on fixed centers and the links 60 . . . 66 are pivotally connected to respective gears each at a distance from the gear center of rotation equal to one half the vertical stroke or distance of movement of the respective pressure shoe. The gears 70 . . . 76 thus act as crank arms moving links 60 . . . 66 to simultaneously drive both sides of stems 50 . . . 56 and prevent pressure shoes 40 . . . 46 from cocking and jamming as they move forward and away from the conduit 37.

A motor 80, mounted adjacent the inlet end of the housing 10, drives a vacuum pump 81 and is provided with a pair of spaced gears 82 in mesh with gears 70. Similarly, a motor 85, mounted adjacent the discharge end of the housing 10, drives a vacuum pump 86 and is provided with a pair of spaced gears 87 in mesh with gears 76. Driving the gear trains from both ends tends to equalize the loading on the gears and eliminates any backlash between the gears. The vacuum pumps 81 and 86 are connected to create low pressure in the chamber 17 for reinflating the flexible conduit 37 after compression and creating suction in the conduit at the inlet connection 38. When a relatively small size pump is used to move relatively low viscosity liquids, in lieu of creating a low pressure atmosphere in chamber 17 with vacuum pumps 81 and 86 to reinflate conduit 37, a wire reinforced conduit, for example, as disclosed by Muehleck U.S. Pat. No. 2,280,252, Smith et al U.S. Pat. No. 2,405,909 or Parr U.S. Pat. No. 3,296,047, utilizing spring wire may be provided which by reference are made part of the present disclosure.

Referring specifically to FIG. 1, pump 10 is particularly adapted for pumping high viscosity material wherein the pressure shoes 40 . . . 46 incrementally trail the preceeding shoe so when shoe 40 is in the fully open conduit position, the shoe 46 fully closes the conduit 38. This is accomplished by progressively offsetting in a trailing direction the connections of the links 60 . . . 66 to gears 70 . . . 76 by 30°. Each of the gears 70 . . . 76 rotates in a direction opposite to the direction of rotation of the adjacent gears. Therefore, each link to gear connection not at 0° or 180° will be on the side opposite from the adjacent link to gear connection.

To provide an over-travel condition when a pressure shoe closes the conduit 37, a compressible pad or mat 69 is provided on the support surface 21. Thus, a pressure shoe will fully close the conduit 37 from 7½° to 15° before the link to gear connection arrives at the 180° position and maintains the closure for an equal distance thereafter. The vertical movement of the pressure shoe during this period will cause localized displacement of the pad 69. This provides the shoes with a dwell time maintaining a closure by each shoe until the following shoe creates the next established closure. In place of the pad 69 to provide dwell times, the arms or links 60 . . . 66 may be made in the form of spring loaded members which lengthen against a spring bias, as each pressure shoe approaches the conduit closing position.

The only extended time that conduit 37 of pump 10 is open, is during the half cycle when shoe 40 is moving from the conduit open to closed position and shoe 46 is simultaneously moving from the conduit closed to open position. This was not found to be detrimental when moving highly viscous material. However, it may be desirable to provide a check valve 18 in the discharge 39 as shown to insure against back flow. It has been found that the check valve 18 enhances the pump operation to a greater degree when lower viscosity materials are being moved.

Figure 2:
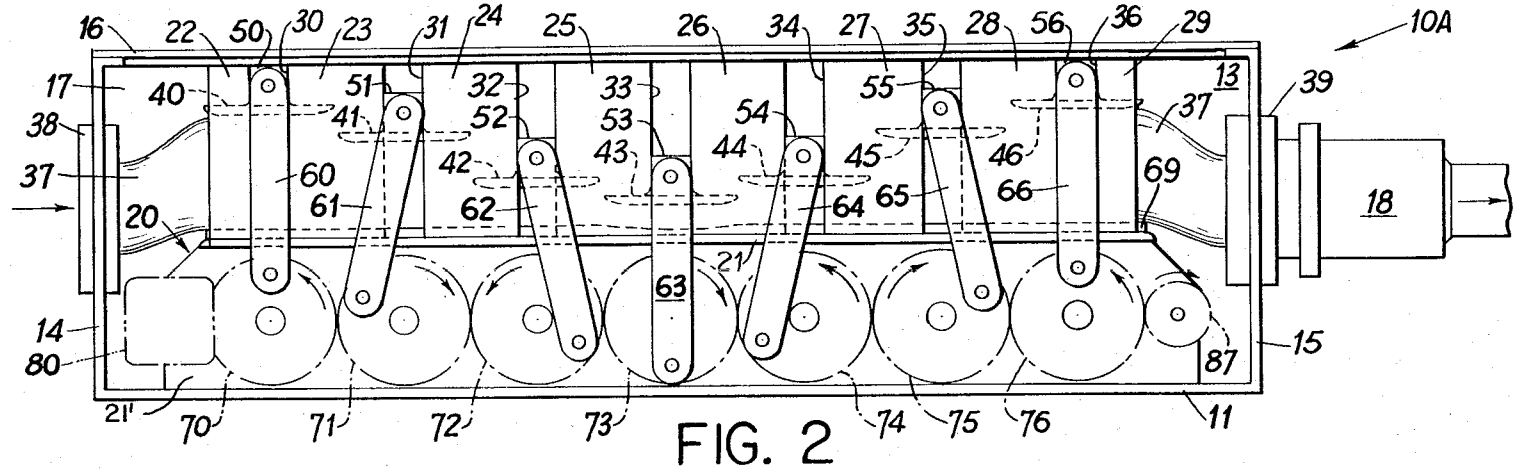
Figure 3:
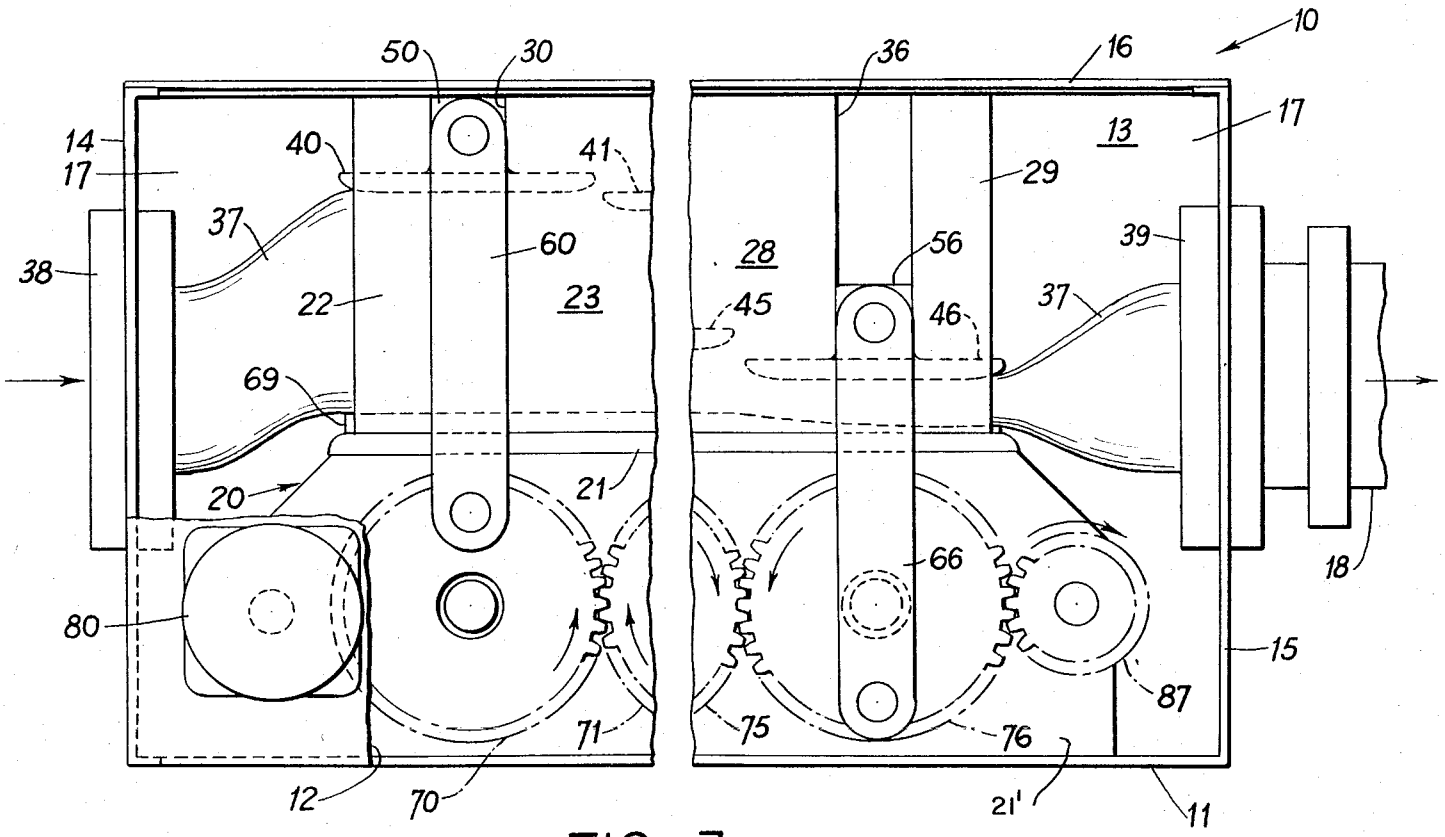
FIG. 3 is an enlarged elevational view with one side wall removed of the end portions of the pump of FIG. 1.
Figure 4:
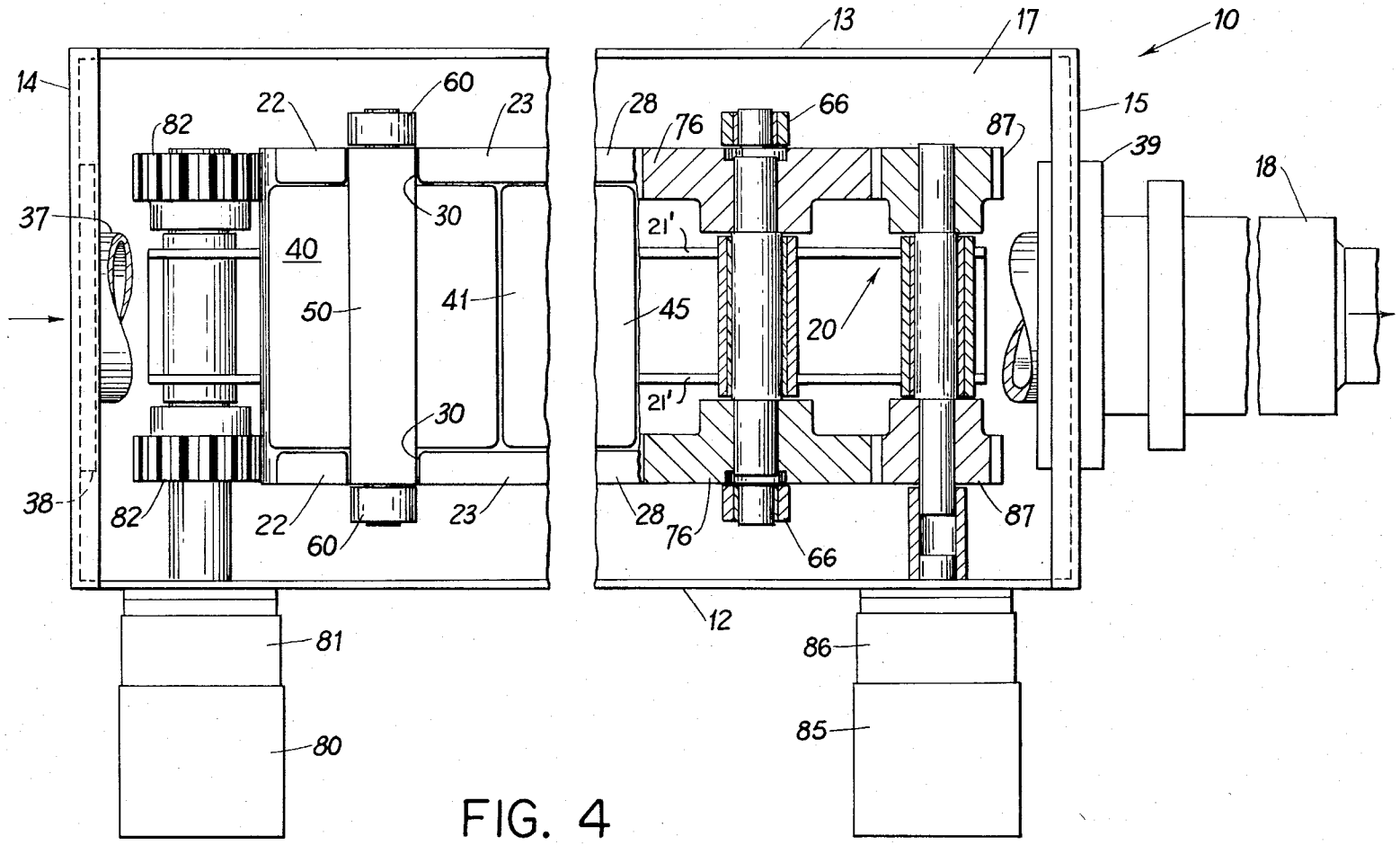
FIG. 4 is a plan view with the cover removed and partly in section of the pump end portions of FIG. 3.

The construction of pump 10A of FIG. 2 is the same as the construction of pump 10 of FIG. 1. The only differences between the pumps as shown are the timing sequences and configurations. Unlike with pump 10, it should be readily seen that with the timing configuration of pump 10A the flow path is never open or a short circuit condition cannot exist for any extended period of time. The conduit 37 of pump 10A can be open at most only momentarily if the dwell times of two adjacent shoes do not overlap. In this arrangement, the link to gear connections are spaced 60° apart in a trailing direction and, if desired, the check valve 18 again may be included. Because of the timing arrangement, the undulations of the conduit 37 are much more rapid and are for briefer periods in pump 10A than in pump 10 which makes pump 10A of FIG. 2 more adapted for handling lower viscosity materials.

Although but a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. A pump comprising:

a housing defining a chamber;

a linear flexible conduit disposed in said chamber having an inlet at one end of said housing to receive material to be moved and a discharge for such material at the other end of said housing;

a fixed surface in said chamber supporting said conduit;

a plurality of shoes disposed in series and movable along linear axes normal to the axis of said conduit thereby compressing said conduit against said support surface by each of said shoes forming a closure of said conduit;

means for moving said shoes in a predetermined sequence forming closures progressively positioned along said conduit to move material from the conduit inlet to the conduit discharge;

laterally spaced guide means including opposed pairs of guide tracks or surfaces extending substantially perpendicular to the support suface on the same side of said surface as said flexible conduit and on either side of said conduit;

said conduit and said shoes disposed between said guide pairs of guide tracks or surfaces; and each of said shoes having stem portions extending into and being movable along an opposed pair of guide tracks or surfaces to limit the movement of each shoe along an axis extending normal to the axis of said conduit.

2. A pump in accordance with claim 1, said frame means further including opposed pairs of gear support means located along opposite sides of said linear conduit and disposed on the opposite side of said support surface away from said guide means;

a plurality of pairs of gears mounted in laterally spaced relationship on said gear support means for rotation in unison;

a plurality of pairs of links, each link of each pair being pivotally connected to and extending between the stem portion of one of said shoes and one of the gears of said pairs of gears at a point on each gear radially spaced from the center of rotation of the gear at a distance equal to the distance of travel of said shoe, whereby each shoe is caused to move towards and away from said conduit by rotation of said gears and movement of said links;

all the gears along the same side of the conduit being in mesh with adjacent gears of said gear pairs thereby forming parallel gear trains along the opposite sides of the conduit;

the connections of said links to said gears of each gear train being equally and progressively offset one from the other on each gear pair in a rotational sense to position said shoes in varying stages of advancement toward and away from the support surface relative to each other; and means driving said gear trains to cause said shoes to move in sequential progression towards and away from the support surface.

3. The pump in accordance with claim 2, including means for driving both ends of both gear trains, thereby equalizing the load on said gears and removing backlash.

4. The pump in accordance with claim 3, including means for providing said shoes with a dwell for maintaining a closure of said conduit during a predetermined amount of terminal travel toward and initial travel away from said conduit.

5. The pump in accordance with claim 4, including means for causing the compressed conduit to expand as the shoe forming a closure moves away and progressively releases a conduit.

6. The pump according to claim 5, further including a discharge connection at said discharge of said conduit; and a check valve connected to said conduit discharge connection for preventing reverse flow in the conduit.

7. The pump in accordance with claim 6, said means providing said shoes with a dwell comprising a pad disposed between said conduit and support surface therefor; and said pad being compressible by movement of each one of said shoes after said shoe has formed a closure of said conduit.

8. The pump in accordance with claim 7, said means causing the compressed conduit to expand comprising at least one vacuum pump connected to reduce the pressure within said chamber below the pressure within said conduit.

9. A pump in accordance with claim 1, said laterally spaced guide means comprising a pair of laterally spaced walls extending generally perpendicular to and above the sides of said fixed surface on either side of said conduit;

said pairs of tracks or guide surfaces comprising aligned opposed openings in said walls.

10. A pump in accordance with claim 2, said gear support means comprising a pair of laterally spaced walls extending generally perpendicular to and below said fixed surface on either side of said conduit;

said pairs of gears rotatably mounted on said pair of walls.

11. A pump in accordance with claim 4, said means for providing said shoes with a dwell including means for maintaining said dwell so that a closure of conduit by each shoe is maintained until the next succeeding shoe creates the next closure of said conduit.

* * * * *